US006363584B1

(12) United States Patent
Gero et al.

(10) Patent No.: US 6,363,584 B1
(45) Date of Patent: Apr. 2, 2002

(54) CUFF LINK WITH CHANGEABLE ELEMENT

(76) Inventors: George Gero, 9536 Wilshire Blvd., Unit 520, Beverly Hills, CA (US) 90212; Leslie C. Hoffman, 4826 Quedo Pl., Woodland Hills, CA (US) 91364; Raymond D. Lathrop, 9648 Donna Ave., Northridge, CA (US) 91324

( * ) Notice: Subject to any disclaimer, the term of this patent is extended or adjusted under 35 U.S.C. 154(b) by 0 days.

(21) Appl. No.: 09/487,424

(22) Filed: Jan. 20, 2000

(51) Int. Cl.[7] ..... A44B 1/04; A44B 21/00; A41D 13/00

(52) U.S. Cl. ..... 24/102 R; 24/90.1; 24/102 T; 24/114.9; 24/303

(58) Field of Search ..... 24/102 R, 102 T, 24/90.1, 114.3, 114.9, 114.11

(56) References Cited

U.S. PATENT DOCUMENTS

| | | | | | |
|---|---|---|---|---|---|
| 2,197,882 | A | * | 4/1940 | Simpson | 24/102 R |
| 2,597,887 | A | * | 5/1952 | Meeker | 24/102 R |
| 2,659,169 | A | * | 11/1953 | Brennan | 24/114.9 |
| 2,860,395 | A | * | 11/1958 | Anderson | 24/90.1 |
| 3,041,697 | A | * | 7/1962 | Budreck | 24/102 R |
| 3,813,732 | A | * | 6/1974 | Seavey | 24/102 T |
| 4,231,137 | A | * | 11/1980 | Fujimoto | 24/303 |
| D263,765 | S | * | 4/1982 | Engelhardt | 24/102 T |
| 4,912,944 | A | * | 4/1990 | Crosley et al | 24/303 |
| 5,845,373 | A | * | 12/1998 | Langer | 24/303 |

FOREIGN PATENT DOCUMENTS

| | | | | |
|---|---|---|---|---|
| JP | 5317105 | * | 12/1993 | 24/90.1 |

* cited by examiner

*Primary Examiner*—Victor N. Sakran
(74) *Attorney, Agent, or Firm*—Elliott N. Kramsky

(57) ABSTRACT

A cuff link includes a magnetic arrangement for ready substitution of alternative decorative elements. One or more links of the cuff link comprises a frame member that is magnetically engageable to a removable element having a decorative exterior surface. The frame and the removable element include mating semi-cylindrical internal surfaces that receive disk-shaped pluralities of magnets. The disk-shaped magnets are arranged so that, when the frame is engaged to the replaceable element, they are aligned along a common axis whereby lines of magnetic flux are axially-directed therethrough to provide a strong bond. An edge of the removable element is bevelled to assist the wearer in ready substitution of replaceable elements.

9 Claims, 2 Drawing Sheets

CUFF LINK WITH CHANGEABLE ELEMENT

BACKGROUND

1. Field of the Invention

The present invention relates to cuff links. More particularly, this invention pertains to a cuff link that includes an interchangeable design feature.

2. Description of the Prior Art

High fashion, elegant cuff links enjoy a limited market due to their expense. This is particularly unfortunate as cuff links are most striking when closely matched to the wearer's other apparel and accessories (e.g. tie and/or handkerchief).

In order to expand the consumer market for such jewelry, attempts have been made to introduce the concept of interchangeability into the high-end market by multiplying the amount of use provided by the cuff link. To date, attempts to provide a cuff link that projects multiple appearances have involved the incorporation of complex lock mechanisms that permit the substitution of links in toto. Such an approach requires the wearer to make any desired link substitutions prior to inserting the cuff link into a shirt cuff. Otherwise, the substitution process is significantly complicated by the tendency of a French cuff to fly off of the post between the front and back links unless both links are in place.

SUMMARY OF THE INVENTION

The present invention addresses the preceding and other shortcomings of the prior art by providing a cuff link that includes a front link and a back link. Means are provided for joining the front link to the back link. At least one of the links comprises a frame engaged to the means for joining and a removable element having an ornamental exterior surface. The frame and the removable element each has at least one internally-mounted magnet arranged for magnetically interlocking a removable element to the frame.

The preceding and other features and advantages of the present invention will be further apparent from the detailed description that follows. Such description is accompanied by a set of drawing figures. Numerals of the drawing figures, corresponding to those of the written description, point to the various features of the invention with like numerals referring to like features throughout both the written description and the drawing figures.

BRIEF DESCRIPTION OF THE DRAWING FIGURES

DETAILED DESCRIPTION OF THE PREFERRED EMBODIMENT

Figure 1:
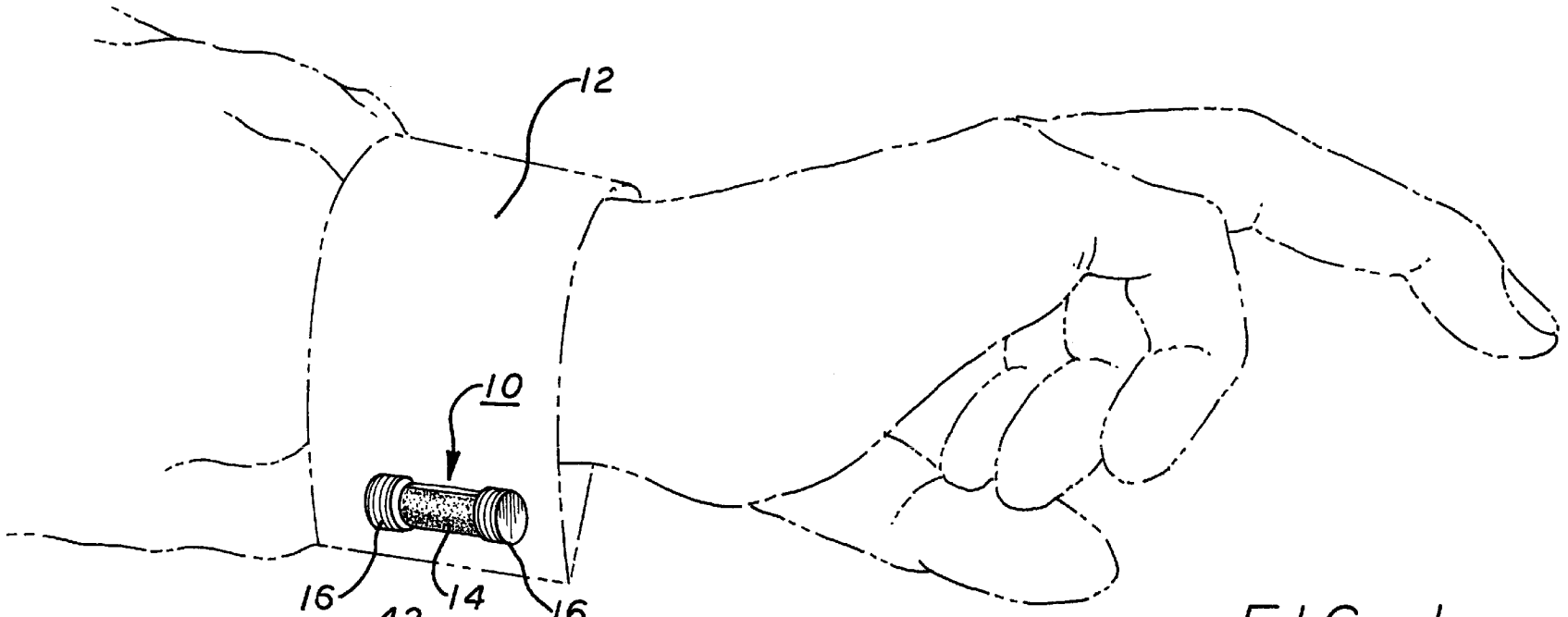
FIG. 1 is a perspective view of a cuff link in accordance with the invention in cooperative engagement with a French-cuffed shirt.

Turning to the drawings, FIG. 1 is a perspective view of a cuff link 10 in accordance with the invention in cooperative engagement with the French cuff 12 of a shirt. The visible link (it being understood that a similar link is mounted to the other side of the cuff 12) comprises a replaceable element 14 having a decorative exterior surface and a frame whose end members 16 are visible and also form a portion of the overall decorative design. It is a central feature of the cuff link 10 of the invention that the replaceable element 14 is readily removable yet securely fixed when engaged to allow the ready substitution of another element having an exterior surface of different ornamental character. In this way, the cuff link 10 may be simply and rapidly reconfigured to present multiple design effects. Such multiple effects may, for example, be undertaken for the purpose of matching the appearance of the cuff link jewelry to the wearer's apparel and/or accessories.

Figure 2:
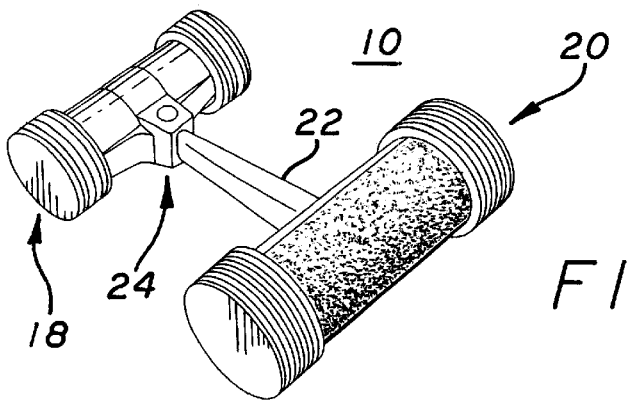
FIG. 2 is a perspective view of a cuff link in accordance with the invention.

FIG. 2 is a perspective view of the cuff link 10. The primary elements of the cuff link 10, including a back link 18, a front link 20 and a post 22 for joining the links are visible in this view. The post 22 is preferably of rigid construction and pivotally fixed to the back link 18 at 24. Such pivotal engagement of the back link 18 to the post 22 facilitates the task of affixing the cuff link 10 to the cuff 12 as it allows the wearer to align the back link 18 with the post 22 for threading through the shirt cuff 12.

Figure 3:
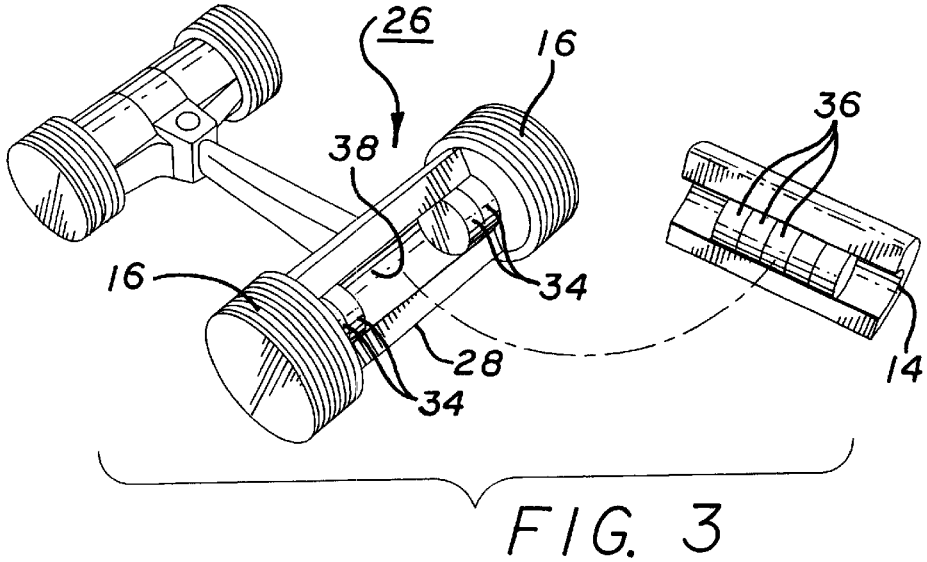
FIG. 3 is an exploded perspective view of a cuff link in accordance with the invention with removable element disengaged from the frame to permit observation of the internal magnetic interlock.

FIG. 3 is an exploded perspective view of the cuff link 10 with the removable element 14 disengaged from the front link frame 26. It will be appreciated that, while the presence of a replaceable element 14 and cooperative structures of the frame 26 pertain to the front link 20, a like arrangement may also be associated with the back link 18.

A central member 28 separates the matching end portions 16 of the frame 26. During the discussion that follows, it shall be apparent that, while the links 18, 20 of the cuff link 10 are of generally-cylindrical shape with enlarged end portions, the teachings of the invention are applicable to cuff links having links of differing shapes and geometries. All of such variants, however, will include internal magnetic interlocks in accordance with the invention, discussed below, for ready and secure substitution of design elements.

Figure 4:
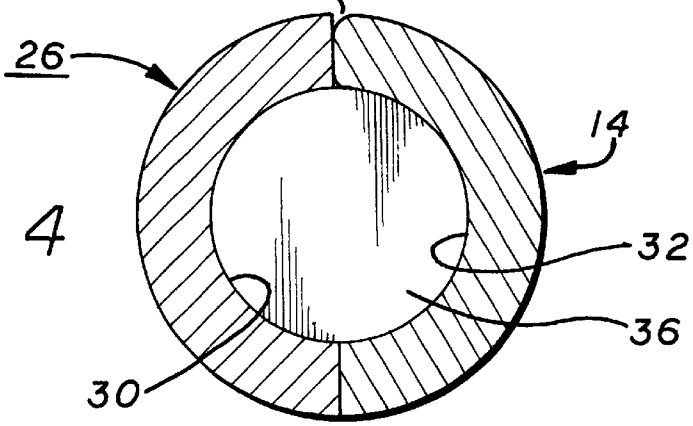
FIG. 4 is a cross-sectional view of a link of a cuff link in accordance with the invention.

Referring to FIG. 3 in combination with FIG. 4, a cross-sectional view of the engaged central member 28 and replaceable element 14, it is seen that a common cylindrical internal chamber is defined therebetween by their mating concave internal surfaces 30 and 32. The cylindrical internal chamber receives a plurality of aligned disk-shaped magnets 34 and 36 separately fixed to the interior of the frame 26 and the replaceable member 14. As can be seen, the pluralities of disk-shaped magnets 34 and 36 are fixed within the semi-cylindrical slotted channels 38, 40 of the frame 26 and the replaceable element 14 respectively and arranged so that, when the two members are engaged, the magnets are aligned along an axis that is coincident with the axis of the internal cylindrical chamber formed between the frame 26 and the replaceable element 14. The pluralities of magnets 34 and 36 are arranged so that, when engaged, the internal surfaces of the two pluralities of magnets 34 are of opposite polarity. In this way, the replaceable element 14 can be engaged to the frame 26 so that surfaces of disk-like magnets 36 of opposite polarities are adjacent those of the plurality of magnets 34. In this way, a very strong magnetic bond is obtained when the replaceable element 14 is lockably seated with respect to the frame 26 because lines of magnetic flux running between the pluralities of magnets 34 and 36 are directed parallel to the common axis.

Referring to FIG. 4 it can be seen that the replaceable element 14 includes a bevelled edge 42. The bevelled shape of the edge 42 provides an area where the wearer may insert his fingernail to dislodge the replaceable element 14 from the frame 26. This further facilitates changing of the decorative appearance of a cuff link 10 without removal from the shirt cuff 12.

Figure 5:
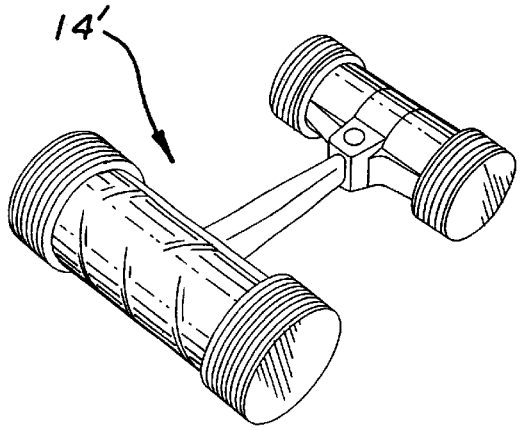
FIG. 5 is a perspective view of an alternative embodiment of the cuff link of the invention configured with a different removable element to provide a different appearance from that of the preceding figures.

FIG. 5 is a perspective view of an alternative embodiment of the cuff link configured with a removable element 14' whose convex exterior surface presents a different look than that of the link 14. Such a different appearance may be obtained, for example, by substitution of a removable element of metallic exterior surface with one having an exterior of mineral composition (e.g. onyx). By substitution of removable elements, one may be assured that the cuff link 10 will provide multiple dramatic combinations suitable for matching different apparel and accessories.

Thus, it is seen that the present invention provides a cuff link suitable for and capable of matching numerous types of apparel and accessories. As the invention relies upon the substitution of a design element to alter the cuff link appearance (as opposed to the substitution of an entire link) a wearer may change the appearance without having to deal with a shirt cuff's tendency to slip off the post. This allows the wearer the freedom to test a number of "looks" without undergoing multiple tedious insertion and removal processes as are required to experiment with prior art changeable cuff links that are based upon the substitution of entire links.

While this invention has been described with reference to its presently-preferred embodiment, it is not limited thereto. For example, the individual links of a cuff link in accordance with the invention needn't be generally-cylindrical. Furthermore, the magnets needn't be disk-shaped and the interior chamber in which the pluralities of magnets are mounted needn't be cylindrical. Square, rectangular and other cross-sections are appropriate and within the scope of the invention. Rather, the invention resides in the provision of a readily-replaceable design element for incorporation into the overall appearance of a link. Accordingly, this invention is limited only insofar as it is defined by the following set of patent claims and includes within its scope all equivalents thereof.

What is claimed is:

1. A cuff link comprising, in combination:

a) a front link;

b) a back link;

c) means for joining said front link to said back link;

d) each of said front and back links comprising a frame engaged to said means for joining and at least one associated removable element having an ornamental exterior surface; and e) each of said frame and said at least one removable element having at least one internally-mounted magnet arranged for magnetically interlocking a removable element to said frame.

2. A cuff link comprising, in combination:

a) a front link;

b) a back link;

c) means for joining said front link to said back link;

d) at least one of said links comprising a frame having an interior slotted portion, said frame engaged to said means for joining and at least one removable element having a mating interior slotted portion, said removable element having an ornamental exterior surface;

e) each of said frame and said at least one removable element having at least one internally-mounted magnet arranged for magnetically interlocking a removable element to said frame; and f) said at least one magnet of said frame and said at least one magnet of said removable element each being fixed within said mating slotted portions.

3. A cuff link comprising, in combination:

a) a front link;

b) a back link;

c) means for joining said front link to said back link;

d) at least one of said links comprising a frame engaged to said means for joining and at least one removable element having an ornamental exterior surface;

e) each of said frame and said at least one removable element having at least one internally-mounted magnet arranged for magnetically interlocking a removable element to said frame;

f) said frame including (i) a central member joined to opposed end members; (ii) said central member having a slotted portion; and (iii) at least one magnet being fixed within said slotted portion; and g) said removable element further including (i) an external ornamental surface and an interior slotted portion; (ii) said at least one magnet being fixed within said interior slotted portion; and (iii) said frame and said removable element being arranged to engage one another so that said internal slotted portion of said frame and said internal slotted portion of said removable element form a continuous internal cavity.

4. A cuff link as defined in claim 3 further characterized in that;

a) each of said magnets is disk-shaped;

b) said frame and said removable element are arranged so that, when engaged, said magnets are aligned along a common axis; and c) adjacent surfaces of magnets fixed within interior slots of said frame and said removable element are of opposite polarity.

5. A cuff link comprising, in combination:

a) a front link;

b) a back link;

c) means for joining said front link to said back link;

d) at least one of said links comprising a frame having a convex exterior surface and a concave internal surface, said frame being engaged to said means for joining and at least one removable element having a convex ornamental exterior surface and a concave internal surface, said frame and said removable element being arranged so that, when engaged to one another, said concave internal surfaces of said frame and said removable element form a continuous closed internal cavity; and e) each of said frame and said at least one removable element having at least one internally-mounted magnet arranged for magnetically interlocking a removable element to said frame.

6. A cuff link as defined in claim 5 wherein:

a) said at least one magnet of said frame is fixed to the said concave internal surface of said frame; and b) said at least one magnet of said removable element is fixed to said concave internal surface of said removable element.

7. A cuff link as defined in claim 6 further characterized in that:

a) said continuous closed internal cavity is cylindrical;

b) each of said at least one magnets is disk-shaped; and c) said at least one magnet of said frame and said at least one magnet of said removable element are aligned along a common axis of symmetry when said removable element is engaged to said frame.

8. A cuff link as defined in claim 7 further characterized in that:

a) each of said frame and said removable element is generally semi-cylindrical so that, when engaged, said link is generally cylindrical; and b) said common axis of symmetry of said magnets coincides with said axis of symmetry of said link formed of said engaged frame and removable element.

9. A cuff link as defined in claim 8 wherein said removable element has a bevelled edge.

* * * * *